US007950746B2

(12) United States Patent
Hall et al.

(10) Patent No.: US 7,950,746 B2
(45) Date of Patent: May 31, 2011

(54) ATTACK TOOL FOR DEGRADING MATERIALS

(75) Inventors: David R. Hall, Provo, UT (US); Ronald B. Crockett, Payson, UT (US); Joe Fox, Spanish Fork, UT (US); Jeff Jepson, Spanish Fork, UT (US); Michael Barnhill, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 11/424,806

(22) Filed: Jun. 16, 2006

(65) Prior Publication Data

US 2007/0290545 A1 Dec. 20, 2007

(51) Int. Cl.
*E21C 35/183* (2006.01)

(52) U.S. Cl. ..... 299/113; 175/435

(58) Field of Classification Search ..... 299/95, 299/100–113; 175/435, 427

See application file for complete search history.

(56) References Cited

U.S. PATENT DOCUMENTS

| | | | | |
|---|---|---|---|---|
| 2,004,315 | A | | 6/1935 | Fean |
| 2,124,438 | A | | 7/1938 | Struk |
| 3,254,392 | A | | 6/1966 | Novkov |
| 3,746,396 | A | | 7/1973 | Radd |
| 3,800,891 | A | | 4/1974 | White |
| 3,807,804 | A | | 4/1974 | Kniff |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,098,362 | A | | 7/1978 | Bonnice |
| 4,109,737 | A | | 8/1978 | Bovenkerk |
| 4,156,329 | A | | 5/1979 | Daniels |
| 4,181,060 | A | * | 1/1980 | Payne ..... 411/16 |
| 4,199,035 | A | | 4/1980 | Thompson |
| 4,201,421 | A | | 5/1980 | Den Besten |
| 4,268,089 | A | | 5/1981 | Spence |
| 4,277,106 | A | | 7/1981 | Sahley |
| 4,439,250 | A | | 3/1984 | Acharya |
| 4,465,221 | A | | 8/1984 | Schmidt |
| 4,484,644 | A | | 11/1984 | Cook |
| 4,484,783 | A | | 11/1984 | Emmench |
| 4,489,986 | A | | 12/1984 | Dziak |
| 4,678,237 | A | | 7/1987 | Collin |
| 4,682,987 | A | | 7/1987 | Brady |
| 4,684,176 | A | | 8/1987 | Den Besten |
| 4,688,856 | A | | 8/1987 | Elfgen |
| 4,725,098 | A | | 2/1988 | Beach |
| 4,729,603 | A | | 3/1988 | Elfgen |
| 4,765,686 | A | | 8/1988 | Adams |

(Continued)

FOREIGN PATENT DOCUMENTS

| | | |
|---|---|---|
| DE | 3500261 | 7/1986 |

(Continued)

*Primary Examiner* — Sunil Singh

(74) *Attorney, Agent, or Firm* — Holme Roberts & Owen LLP

(57) ABSTRACT

An attack tool for degrading materials is disclosed which comprises a base segment comprising an attachment to a driving mechanism, a first wear-resistant segment bonded to the base segment, a second wear-resistant segment bonded to the first wear-resistant segment at a brazed joint opposite the base segment, and at least a portion of exterior surfaces of both the wear-resistant segments proximate the joint, the portion of exterior surfaces comprising a finish ground surface.

16 Claims, 15 Drawing Sheets

U.S. PATENT DOCUMENTS 4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
4,993,505 A * 2/1991 Packer et al. ..... 175/431
5,007,685 A 4/1991 Beach
5,011,515 A 4/1991 Frushour
5,035,355 A * 7/1991 Dollhopf ..... 228/104
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,303,984 A 4/1994 Ojanen
5,332,348 A 7/1994 Lemelson
5,351,595 A * 10/1994 Johnston ..... 83/848
5,417,475 A 5/1995 Graham
5,447,208 A 9/1995 Lund
5,494,477 A 2/1996 Flood
5,535,839 A 7/1996 Brady
5,542,993 A 8/1996 Rabinkin
5,653,300 A 8/1997 Lund
5,720,528 A 2/1998 Ritchey
5,738,698 A 4/1998 Kapoor
5,823,632 A 10/1998 Burkett
5,837,071 A 11/1998 Andersson
5,845,547 A 12/1998 Sollami
5,875,862 A 3/1999 Jurewicz
5,884,979 A 3/1999 Latham
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A * 4/2000 Andersson et al. ..... 148/318
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,481,803 B2 11/2002 Ritchey
6,499,547 B2 * 12/2002 Scott et al. ..... 175/374
6,517,902 B2 2/2003 Drake
6,585,326 B2 7/2003 Sollami
6,685,273 B1 2/2004 Sollami
6,702,393 B2 3/2004 Mercier
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery
6,824,225 B2 11/2004 Stiffler
6,861,137 B2 3/2005 Hughes
6,889,890 B2 5/2005 Yamazaki
6,966,611 B1 11/2005 Sollami
6,994,404 B1 2/2006 Sollami
7,204,560 B2 4/2007 Mercier
2002/0074851 A1 6/2002 Montgomery
2002/0153175 A1 10/2002 Ojanen
2002/0175555 A1 11/2002 Mercier
2003/0079565 A1 5/2003 Liang
2003/0141350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2006/0201712 A1 * 9/2006 Zhang et al. ..... 175/57
2006/0237236 A1 10/2006 Sreshta

FOREIGN PATENT DOCUMENTS

DE 3818213 11/1989
DE 4039217 6/1992
DE 4039217 A1 * 6/1992
DE 19821147 11/1999
DE 10163717 5/2003
EP 0295151 6/1988
EP 0412287 7/1990
EP 412287 A2 * 2/1991
GB 2004315 3/1979
GB 2037223 11/1979

* cited by examiner

ATTACK TOOL FOR DEGRADING MATERIALS

BACKGROUND OF THE INVENTION

Efficient degradation of materials is important to a variety of industries including the asphalt, mining, and excavation industries. In the asphalt industry, pavement may be degraded using attack tools, and in the mining industry, attack tools may be used to break minerals and rocks. Attack tools may also be used when excavating large amounts of hard materials. In asphalt recycling, often, a drum supporting an array of attached attack tools may be rotated and moved so that the attack tools engage a paved surface causing the tools, which typically have a tungsten carbide tip, to wear. Much time is wasted in the asphalt recycling industry due to high wear of the tools.

U.S. Pat. No. 6,733,087 to Hall et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a superhard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in the region of greatest variance.

BRIEF SUMMARY OF THE INVENTION

In one aspect of the invention, an attack tool for degrading materials comprises a base segment comprising an attachment to a driving mechanism, a first wear-resistant segment bonded to the base segment, a second wear-resistant segment bonded to the first wear-resistant segment at a brazed joint opposite the base segment, and at least a portion of exterior surfaces of both the wear-resistant segments proximate the joint, the portion of exterior surfaces comprising a finish ground surface.

In another aspect of the invention, a method for manufacturing an attack tool is also disclosed. The method may comprise the steps of providing a first wear-resistant segment and providing a superhard material bonded to a second wear-resistant segment, forming a joint by brazing the first and second wear-resistant segments together, and removing by grinding a braze-induced affected zone proximate the brazed joint.

DETAILED DESCRIPTION OF THE INVENTION AND THE PREFERRED EMBODIMENT

Figure 1:
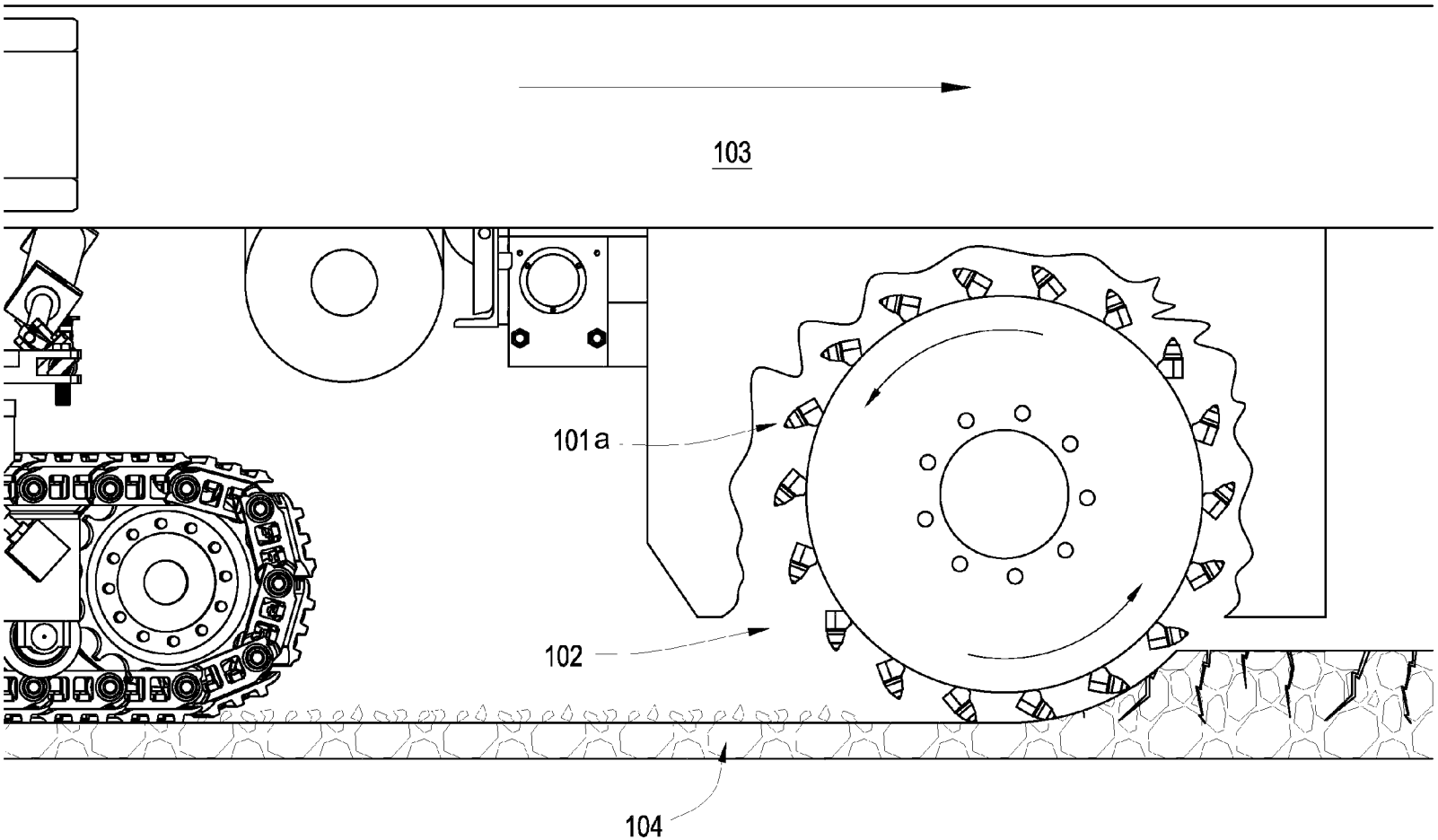
FIG. 1 is a cross-sectional diagram of an embodiment of an attack tool on a rotating drum attached to a motor vehicle.

It will be readily understood that the components of the present invention, as generally described and illustrated in the Figures herein, may be arranged and designed in a wide variety of different configurations. FIG. 1 is a cross-sectional diagram of an embodiment of an attack tool 101*a* on a driving mechanism 102 attached to a motor vehicle 103. The driving mechanism 102 may be a rotating drum. The motor vehicle 103 may be a cold planer used to degrade pavement 104 prior to the placement of a new layer of pavement, or a mining vehicle used to degrade natural formations. Attack tools 101*a* are attached to the driving mechanism 102, which rotates so that the attack tools 101*a* engage and degrade the pavement 104. The pavement 104 may cause substantial wear on the attack tools 101*a*. When the attack tools 101*a* wear enough, the attack tools 101*a* need to be replaced. The maintenance required to replace these attack tools 101*a* may be burdensome and costly because of down time.

Figure 2:
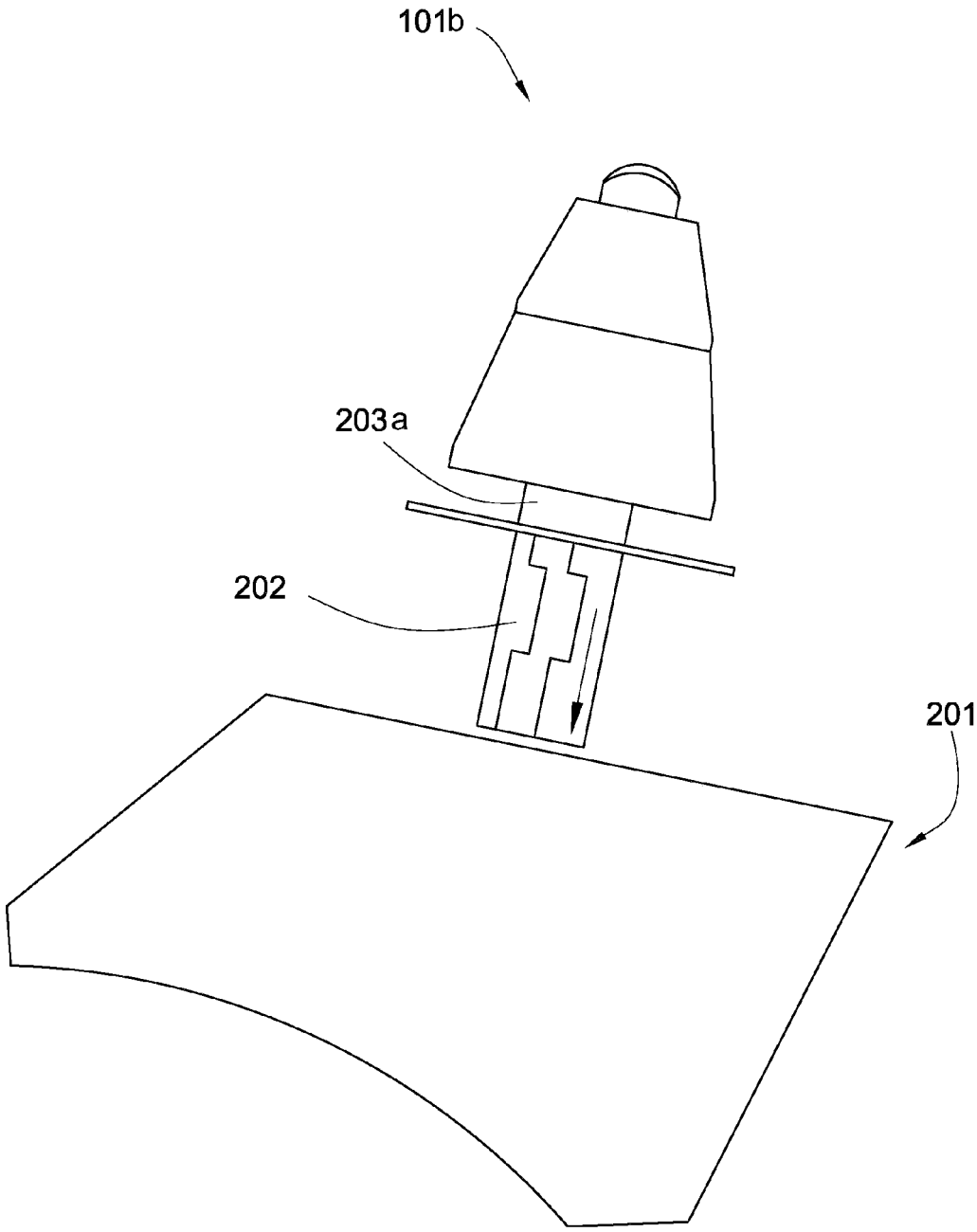
FIG. 2 is an orthogonal diagram of another embodiment of an attack tool and a holder.

FIG. 2 is an orthogonal diagram of an embodiment of an attack tool 101*b* secured within a holder 201. The holder 201 may be secured to a driving mechanism, such as the driving mechanism 102 illustrated in FIG. 1. The holder 201 may hold the attack tool 101*b* at an angle to increase the degradation efficiency of the attack tool 101*b*. An end of the attack tool 101*b* may comprise an attachment 203*a*, such as a shaft. The holder 201 may support the attack tool 101*b* at an angle offset from the direction of rotation, such that as the attack tool 101*b* engages a paved surface, such as the pavement 104 illustrated in FIG. 1, the attack tool 101*b* rotates within the holder 201. A sheath 202 may be fitted around an attachment 203*a* to enable or improve the rotation of the attack tool 101*b*. Rotation may be beneficial in that it may result in more even wear on the attack tool 101*b* instead of having most of the wear concentrated on one side of the attack tool 101*b*.

Figure 3:
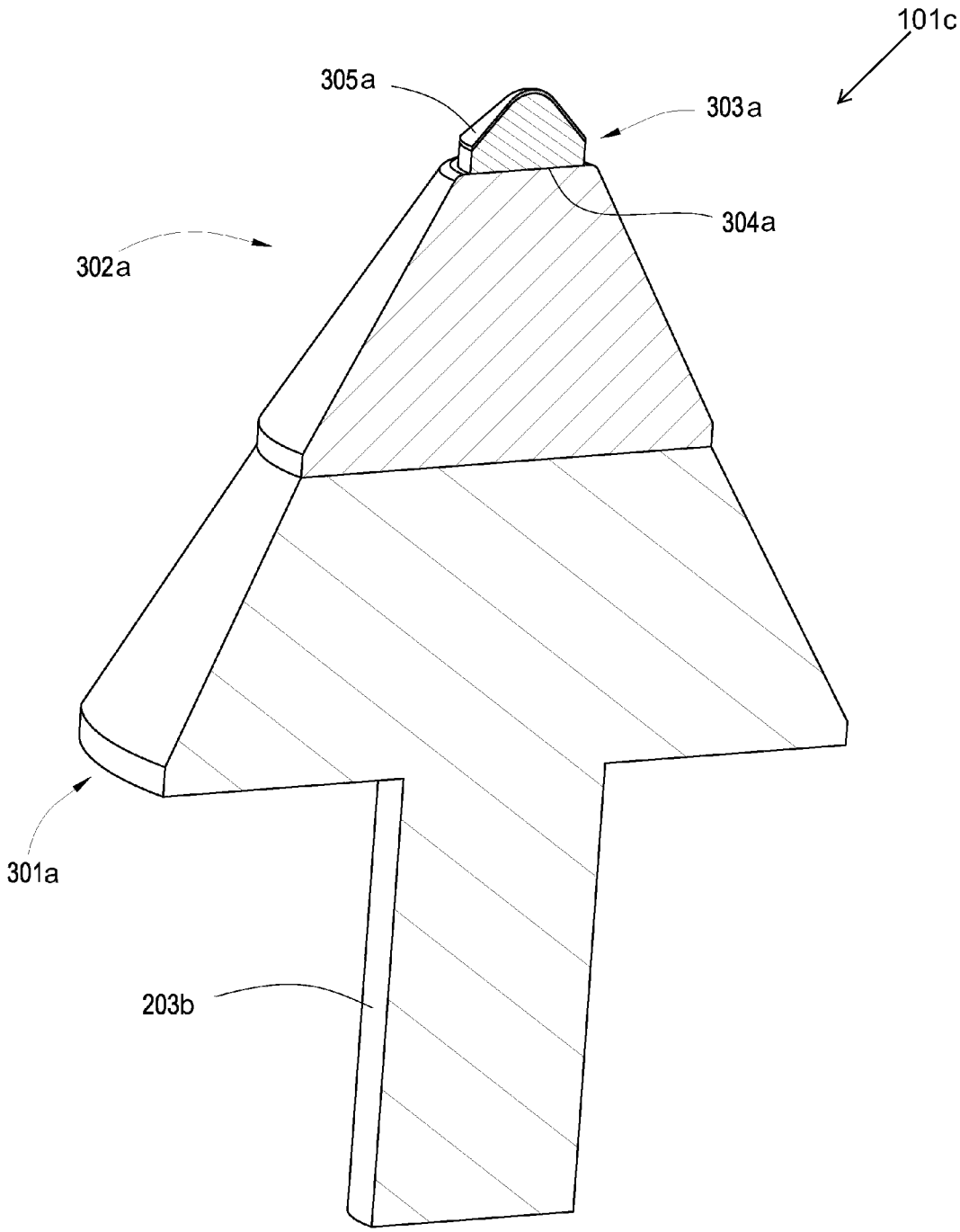
FIG. 3 is a cross-section of a perspective diagram of another embodiment of an attack tool.

FIG. 3 is a cross-section of a perspective diagram of another embodiment of an attack tool 101*c*. The attack tool 101*c* may comprise a base segment 301*a* which may be made of steel, cemented metal carbide, or combinations thereof. The base segment 301*a* may comprise an attachment 203*b*, such as a shaft, that attaches to a driving mechanism, such as the driving mechanism 102 illustrated in FIG. 1. The attack tool 101*c* may further comprise a first wear-resistant segment 302*a* that is bonded to the base segment 301*a*. The first wear-resistant segment 302*a* may comprise steel, a cemented metal carbide, tungsten, silicon, niobium, or combinations thereof. A second wear-resistant segment 303*a*, which may comprise steel, a cemented metal carbide, tungsten, silicon, niobium, or combinations thereof, may be bonded to the first wear resistant segment 302*a* at a brazed joint 304*a* opposite the base segment 301*a*.

There may also be a superhard material 305*a* bonded to the second wear-resistant segment 303*a* opposite the brazed joint 304*a*. The superhard material 305*a* may comprise a domed, rounded, semi-rounded, conical, flat, or pointed geometry, and the superhard material may further comprise natural diamond, polycrystalline diamond, boron nitride, or combinations thereof. The superhard material 305*a* may be bonded to the second wear-resistant segment 303*a* by various processes, including high pressure/high temperature, chemical vapor deposition, physical vapor deposition, or combinations thereof.

Figure 4:
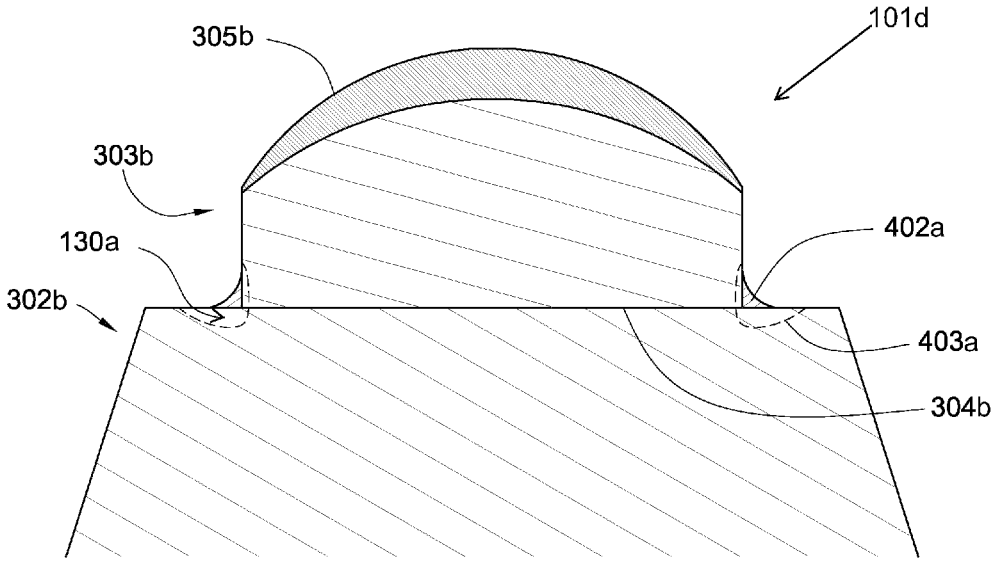
FIG. 4 is a cross-sectional diagram of an embodiment of an attack tool that includes a first wear-resistant segment, a second wear-resistant segment, a brazed joint, and a braze-affected zone.

FIG. 4 is a cross-sectional diagram of an embodiment of an attack tool 101*d* that includes a first wear-resistant segment 302*b*, a second wear-resistant segment 303*b*, a brazed joint 304*b* joining the first wear-resistant segment 302*b* and the a second wear-resistant segment 303*b*, and a braze-affected zone 130*a*.

Preferably the first wear-resistant segment 302*b* and the second wear-resistant segment 303*b* comprise a cemented metal carbide, preferably tungsten carbide.

The brazed joint 304*b* may comprise a braze material comprising silver, gold, copper, nickel, palladium, boron, chromium, silicon, germanium, aluminum, iron, cobalt, manganese, titanium, tin, gallium, vanadium, indium, phosphorus, molybdenum, platinum, or combinations thereof.

Excess braze material 402*a* may extrude to the outside of the brazed joint 304*b* when the first wear-resistant segment 302*b* and the second wear-resistant segment 303*b* are brazed together. Additionally, brazing may result in an affected zone 130*a* which is indicated by dotted lines 403*a*. The affected zone 130*a* may be weakened by cracks, depressions, scrapes, or other irregularities and/or imperfections as a result of the brazing. The affected material in the affected zone 103 in either the first wear-resistant segment 302*b* and the second wear-resistant segment 303*b* may initiate a break especially in embodiments where the first wear-resistant segment 302*b* and the second wear-resistant segment 303*b* comprise brittle materials, such as tungsten carbide.

Figure 5:
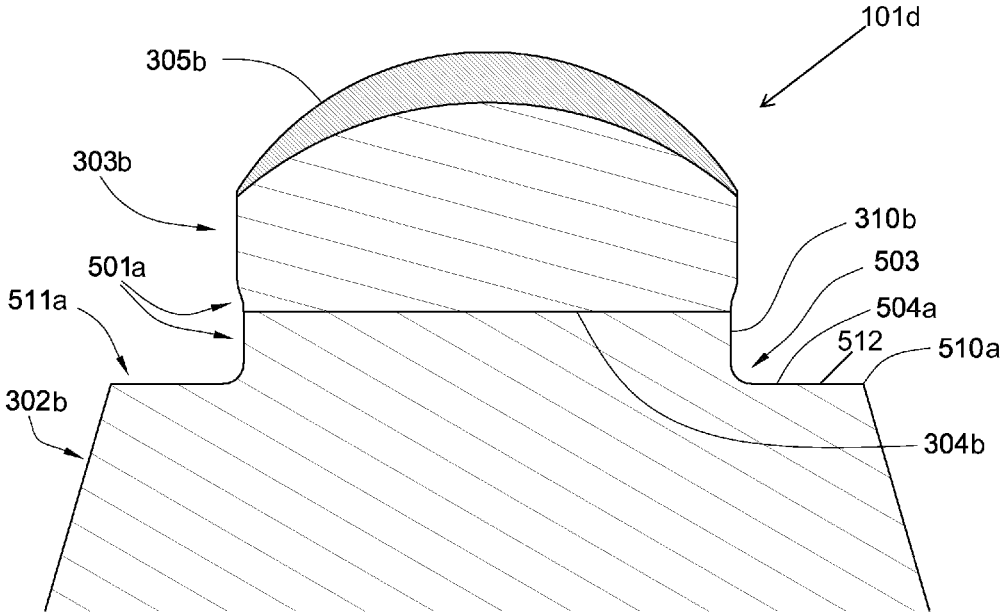
FIG. 5 is a cross-sectional diagram of the embodiment of the attack tool illustrated in FIG. 4 in which a braze-affected zone has been removed and a portion of an exterior surface of the first and second wear-resistant segments includes a finish ground surface.

To mitigate the effects of the affected zone 130*a*, and, consequently, reduce or remove any braze-induced weaknesses the first wear-resistant segment 302*b* and the second wear-resistant segment 303*b*, the affected zone 130*a* is removed. FIG. 5 is a cross-sectional diagram of the embodiment of the attack tool 101*d* illustrated in FIG. 4 in which the braze-affected zone 130*a* has been removed and a portion of an exterior surface 501*a* proximate the brazed joint 304*b* of the first wear-resistant segment 302*b* and the second wear-resistant segment 303*b* includes a finish ground surface 504*a*.

The first wear-resistant segment 302*b* may also comprises an outer diameter 310*b* and an edge 510*a* joined by a fillet 503. The radius of the fillet 503 may be 0.005 to 0.600 inches and may include a shelf 511 that joins the edge 510*a* to the fillet 503. An additional benefit of the fillet 503 may be that a stress point that results from a 90 degree angle formed by the first wear-resistant segment 302*b* and the second wear-resistant segment 303*b* before grinding is reduced. When the first wear-resistant segment 302*b* and the second wear-resistant segment 303*b* are ground as indicated in FIG. 5, the stress may be distributed away from the brazed joint 304*b*, extending its life.

In the embodiment of the attack tool 101*d* that has been processed as illustrated in FIG. 5, surfaces of the attack tool 101*d*, such as the edge 510*a* and shelf 511*a*, may be susceptible to high wear. A durable coating 512 may be bonded to those surfaces susceptible to high wear. The durable coating 512 may comprise diamond, polycrystalline diamond, cubic boron nitride, diamond grit, polycrystalline diamond grit, cubic boron nitride grit, or combinations thereof. The durable coating 512 may be deposited by chemical vapor deposition; physical vapor deposition; blasting diamond grit, polycrystalline diamond grit, cubic boron nitride grit, sintering or combinations thereof.

Figure 6:
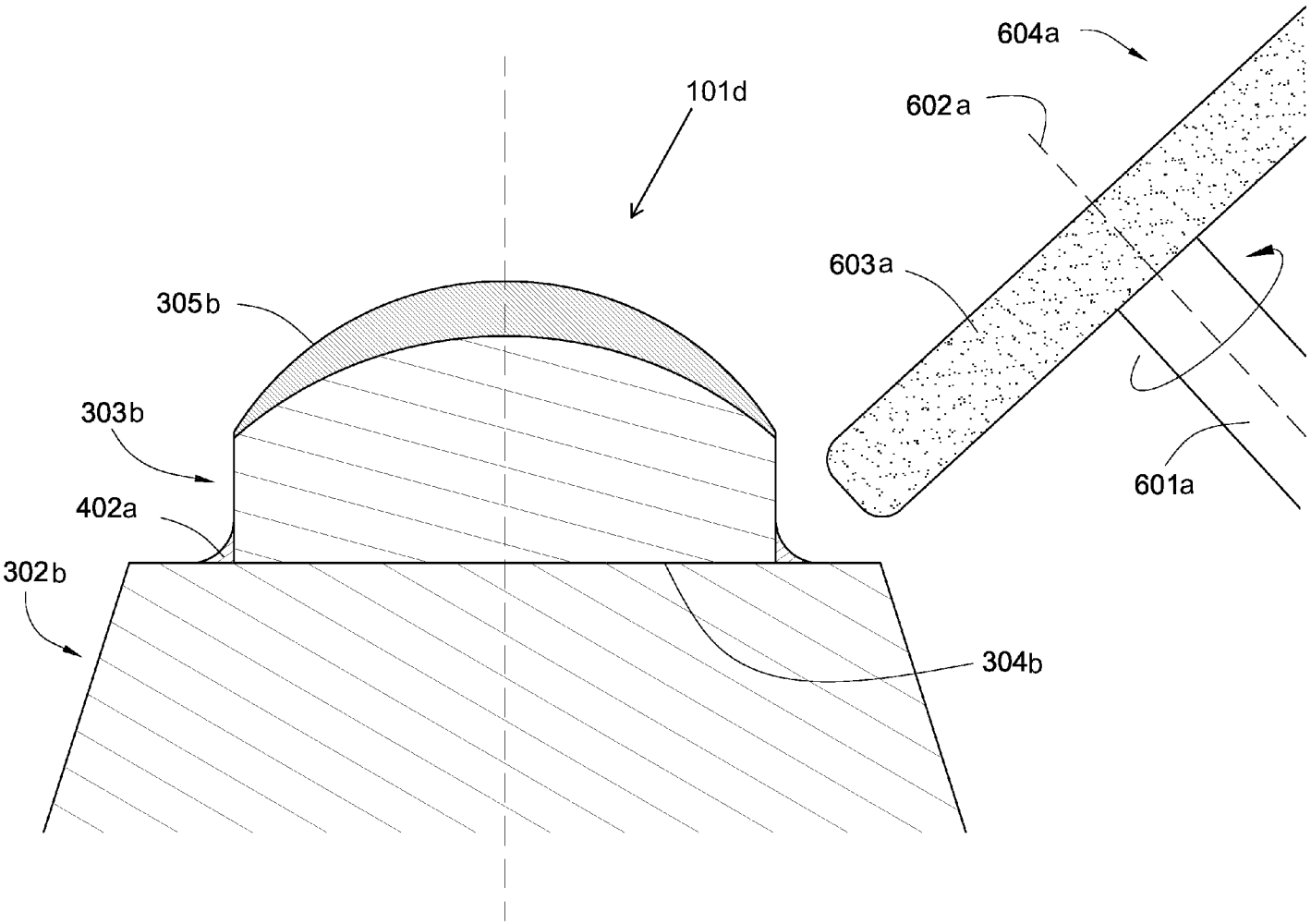
FIG. 6 is a cross-sectional diagram of the embodiment of the attack tool illustrated in FIG. 4 in which the braze-affected zone will be removed and a finish grinding of a portion of an exterior surface of the first and second wear resistant segments is performed by an embodiment of a grinding tool.

FIG. 6 is a cross-sectional diagram of the embodiment of the attack tool 101*d* illustrated in FIG. 4 in which the braze-affected zone 130*a* will be removed proximate the brazed joint 304*b* of the first wear-resistant segment 302*b* and the second wear-resistant segment 303*b* and a finish grinding of a portion of an exterior surface 501*a* to provide a finish ground surface 504*a* (illustrated in FIG. 5) is performed by an embodiment of a grinding tool. After brazing, excess braze material 402*a* may be ground away, in addition to the affected zone 130*a*, which includes portions of the first wear-resistant segment 302*b* and the second wear-resistant segment 303*b* f.

A grinding tool 604*a*, such as a dremel, may comprise a grinding element 603*a* attached to a shaft 601*a*. The grinding element 603*a* may rotate along an axis 602*a* of the shaft 601*a*. The grinding element 603*a* may comprise fine or coarse diamond grit or other materials suitable for grinding. Grinding, however, may leave small cracks, abrasions, grooves, or other irregularities and/or imperfections behind which may weaken the attack tool 101*d* when in use, although it is believed to still be an improvement over leaving the affected zone 130*a* in place. Therefore, the finish ground surface 504*a* may be polished. Polishing may remove irregularities and/or imperfections. In selected embodiments, grinding, lapping, hand polishing, annealing, sintering, direct firing, wet etching, dry etching, or a combination thereof, may be used to aid in polishing the attack tool 101*d*. In other embodiments of the grinding and polishing process, the attack tool 101*d* may be polished in multiple stages. In either case, a layer of material which may comprise the irregularities and/or imperfections may be removed in an effort to strengthen the attack tool 101*d*.

Figure 7:
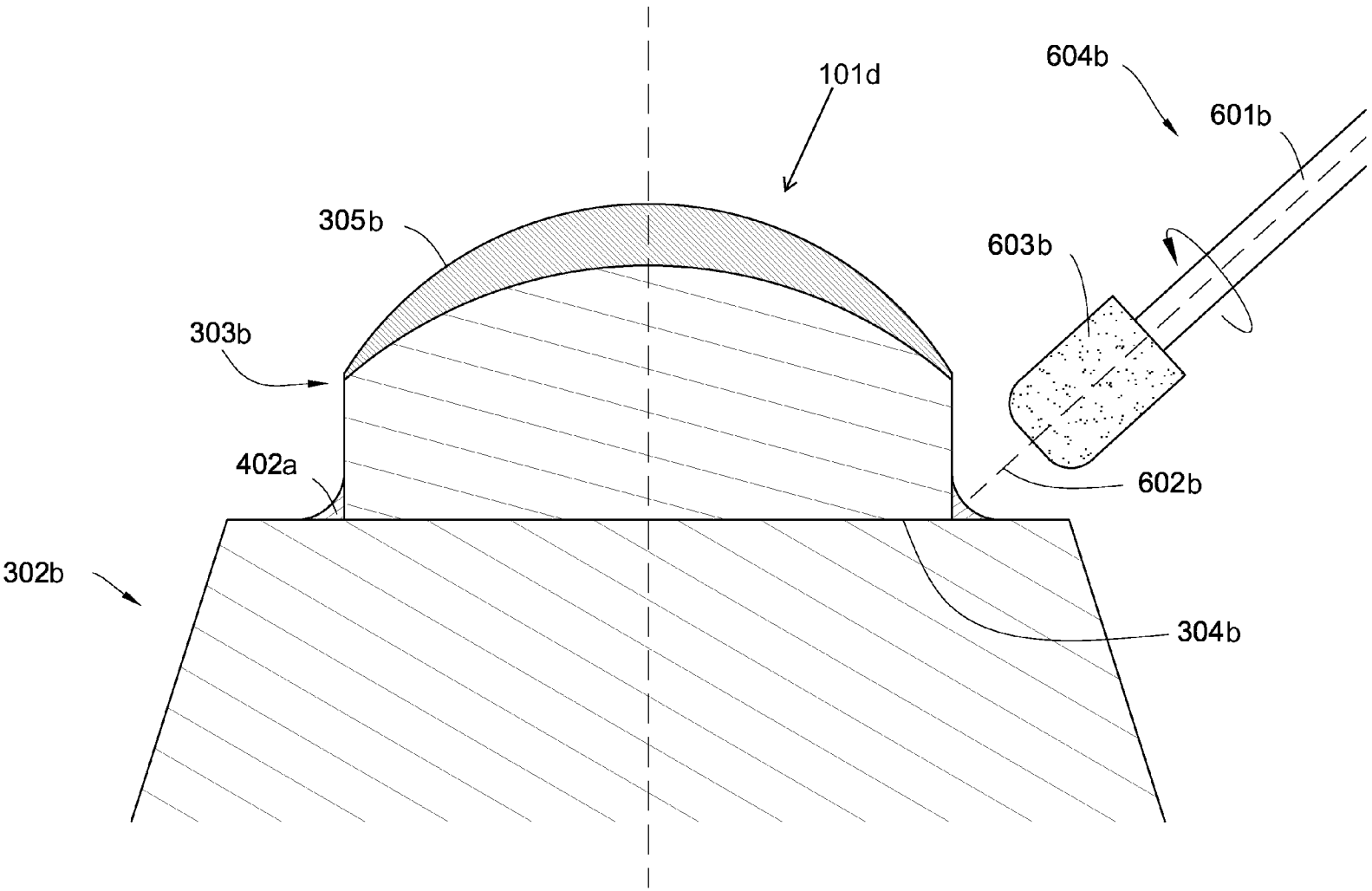
FIG. 7 is a cross-sectional diagram of the embodiment of the attack tool illustrated in FIG. 4 in which the braze-affected zone will be removed and a finish grinding of a portion of an exterior surface of the first and second wear resistant segments is performed by another embodiment of a grinding tool.

FIG. 7 is a cross-sectional diagram of the embodiment of the attack tool 101*d* illustrated in FIG. 4 in which the braze-affected zone 130*a* will be removed proximate the brazed joint 304*b* of the first wear-resistant segment 302*b* and the second wear-resistant segment 303*b* and a finish grinding of a portion of an exterior surface 501*a* to provide a finish ground surface 504*a* (illustrated in FIG. 5) is performed by another embodiment of a grinding tool.

The grinding tool 604*b* may comprise a grinding element 603*b* attached to a shaft 601*b*. The grinding element 603*b* may rotate along an axis 602*b* of the shaft 601*b*, and may comprise fine or coarse diamond grit or other material suitable for grinding. The shape of the grinding element 603*a* may be changed to form different geometries instead of a fillet, such as the fillet 503 illustrated in FIG. 5.

Figure 8:
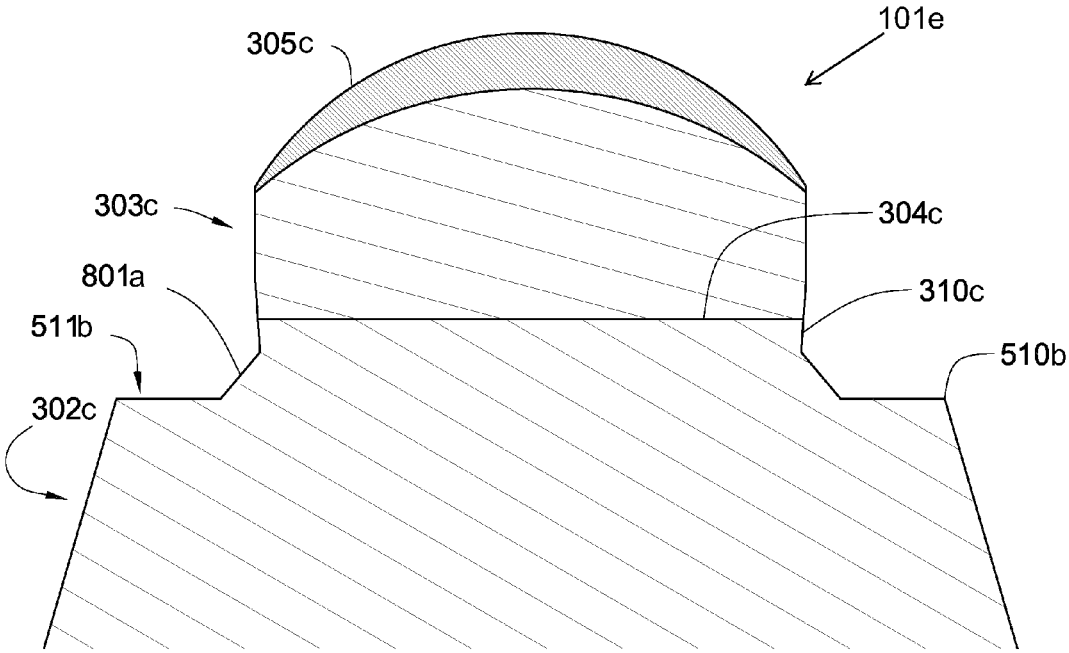
FIG. 8 is a cross-sectional diagram of another embodiment of an attack tool that includes another embodiment of a finish ground surface of an exterior surface of a first and second wear resistant segments.

FIG. 8 is a cross-sectional diagram of another embodiment of an attack tool 101*e* that includes another embodiment of a finish ground surface of an exterior surface of a first wear-resistant segment 302*c* and a second wear-resistant segment 303*c*. The first wear-resistant segment 302*c* comprises an outer diameter 310*c* and an edge 510*b* joined by at least one substantially conic section 801*a* and a shelf 511*b*. The at least one conic section 801*a*, or a shelf 511*b* may comprise a finish ground surface 501*b*. The conic section 801*a* may form obtuse angles with the shelf 511*b* and the outer diameter 510*b*. These angles may still be stress points, but the stress may be spread between them and be below the brazed joint 304*c*. Polishing may also remove any irregularities and/or imperfections leftover from or created by grinding.

Figure 9:
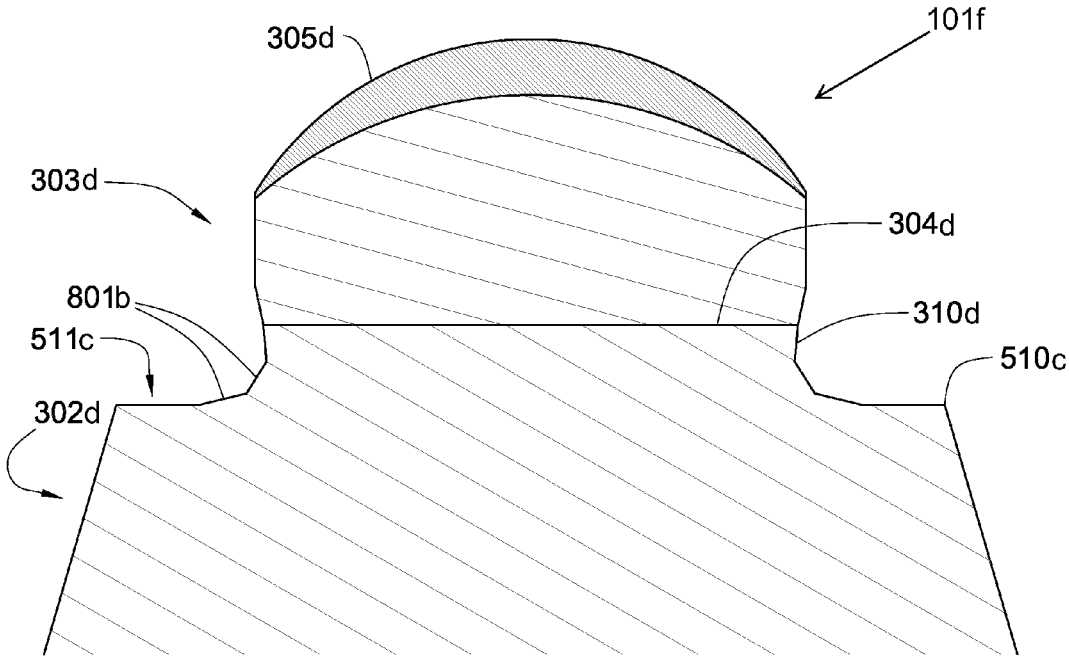
FIG. 9 is a cross-sectional diagram of an attack tool that includes another embodiment of a finish ground surface of an exterior surface of a first and second wear resistant segments.

FIG. 9 is a cross-sectional diagram of another embodiment of an attack tool 101*f* that includes another embodiment of a finish ground surface of an exterior surface of a first wear-resistant segment 302*d* and a second wear-resistant segment 303*d*. A plurality of substantially conic sections 801*b* may be used to join the outer diameter 310*d* and edge 510*c*. In FIG. 9, two or more conic sections 801*b* and a shelf 511*c* are used. Again, other obtuse angles may be created when multiple conic sections 801*b* which may serve to further disperse the stresses encountered when the attack tool 101*f* is in use.

Figure 10:
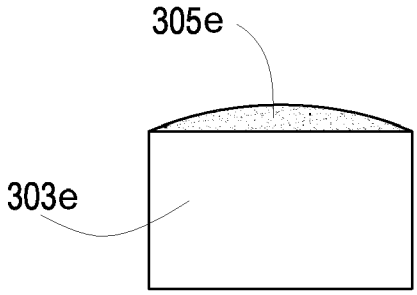
FIG. 10 is a side-view of an embodiment of a second wear-resistant segment and a superhard material bonded to the second wear-resistant segment.
Figure 11:
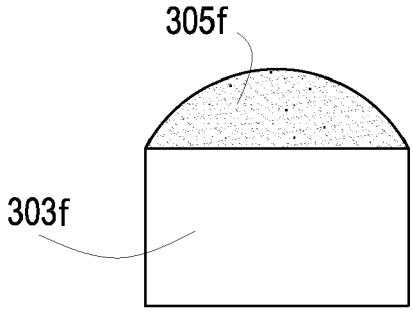
FIG. 11 is a side-view of another embodiment of a second wear-resistant segment and a superhard material bonded to the second wear-resistant segment.
Figure 12:
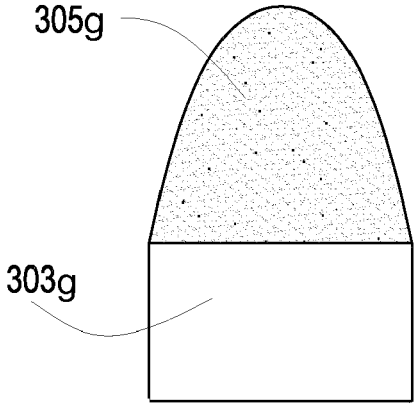
FIG. 12 is a side-view of another embodiment of a second wear-resistant segment and a superhard material bonded to the second wear-resistant segment.
Figure 13:
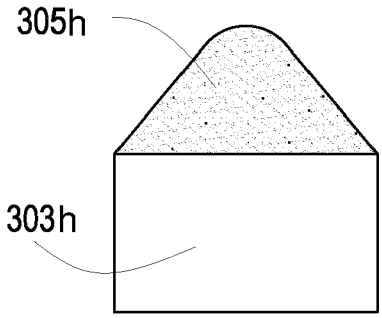
FIG. 13 is a side-view of another embodiment of a second wear-resistant segment and a superhard material bonded to the second wear-resistant segment.
Figure 14:
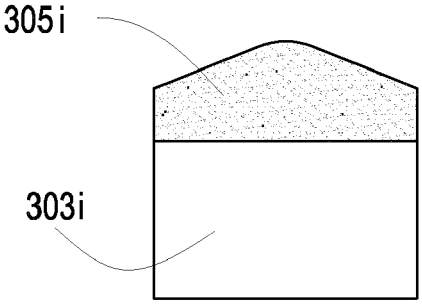
FIG. 14 is a side-view of another embodiment of a second wear-resistant segment and a superhard material bonded to the second wear-resistant segment.
Figure 15:
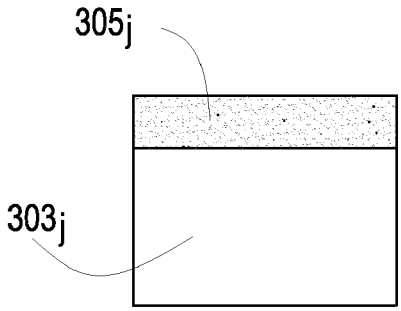
FIG. 15 is a side-view of another embodiment of a second wear-resistant segment and a superhard material bonded to the second wear-resistant segment.

FIGS. 10 through 15 are cross-sectional diagrams of a superhard material bonded to a second wear-resistant segments. FIG. 10 shows a second wear-resistant segment 303*e* bonded to a superhard material 305*e* comprising a rounded geometry. FIG. 11 shows a second wear-resistant segment 303*f* bonded to a superhard material 305*f* comprising a domed geometry. FIG. 12 shows a second wear-resistant segment 303*g* bonded to a superhard material 305*g* comprising a conical geometry. FIG. 13 shows a second wear-resistant segment 303*h* bonded to a superhard material 305*h* comprising a semi-rounded geometry. FIG. 14 shows a second wear-resistant segment 303*i* bonded to a superhard material 30*i*5 comprising a pointed geometry. FIG. 15 shows a second wear-resistant segment 303*j* bonded to a superhard material 305*j* comprising a flat geometry. Each geometry may change the cutting properties of an attack tool, such as attack tool 101*a* illustrated in FIG. 1. A pointed geometry may allow for more aggressive cutting. While a rounded geometry may reduce wear by distributing stresses and make cutting less aggressive.

Figure 16:
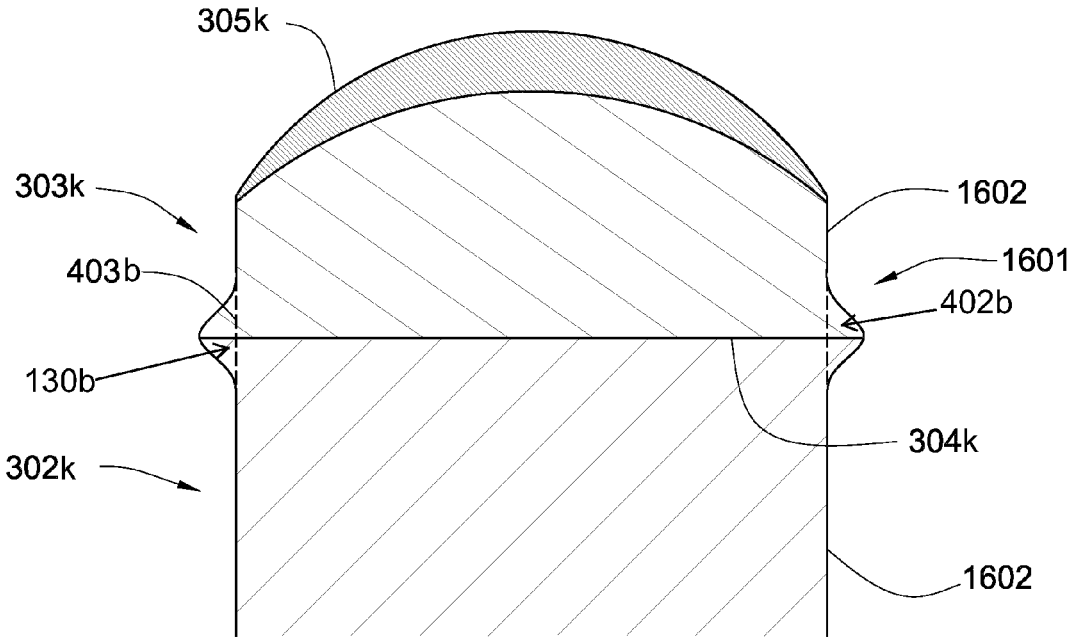
FIG. 16 is a cross-sectional diagram of an embodiment of a sacrificial material at a brazed joint between a first wear-resistant segments and a second wear-resistant segment.

FIG. 16 is a cross-sectional diagram of an embodiment of a sacrificial area 1601 proximate a brazed joint 304*k* between a first wear-resistant segments 302*k* and a second wear-resistant segment 303*k*. Excess braze material 402*b* may extrude to the outside of the brazed joint 304*b* when the first wear-resistant segment 302*k* and the second wear-resistant segment 303*k* are brazed together for the purpose of being the sacrificial area 1601. After brazing, a affected zone 130*b*, indicated by the dotted lines 403*b*, may be contained in the sacrificial area 1601, which may then be ground away to leave the desired shape of the outer surfaces.

Figure 17:
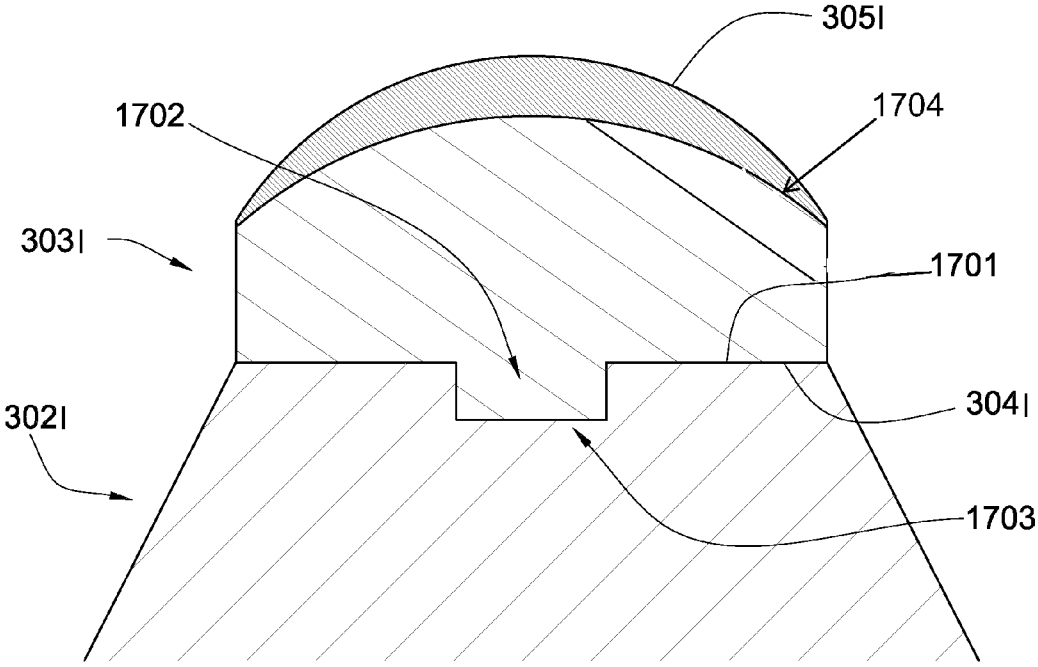
FIG. 17 is a cross-sectional diagram of an embodiment of a non-planar interface between a first wear-resistant segment and a second wear-resistant segment.

FIG. 17 is a cross-sectional diagram of an embodiment of a first non-planar interface 1701 between a first wear-resistant segment 302*l* and a second wear-resistant segment 303*l*. A second non-planar interface 1704 is also between the second wear-resistant segment 303*l* and a superhard material 305*l*. The non-planar interface 1701 between the first wear-resistant segment 302*l* and a second wear-resistant segment 303*l* at a brazed joint 304*l* may increase the area of the brazed joint 304*l* and strengthen the bond. Similarly, the non-planar interface 1704 between the second wear-resistant segment 303*l* and the superhard material 305*l* may also strengthen their bond. The non-planar interface 1701 between the first wear-resistant segment 302*l* and a second wear-resistant segment 303*l* may comprise at least one protrusion 1702 disposed within the second wear-resistant segment 303*l* that is fitted within at least one recess 1703 disposed within the first wear-resistant segment 302*l*. Other embodiments may include complementary curved surfaces, such as that exhibited by the second non-planar interface 1704.

Figure 18:
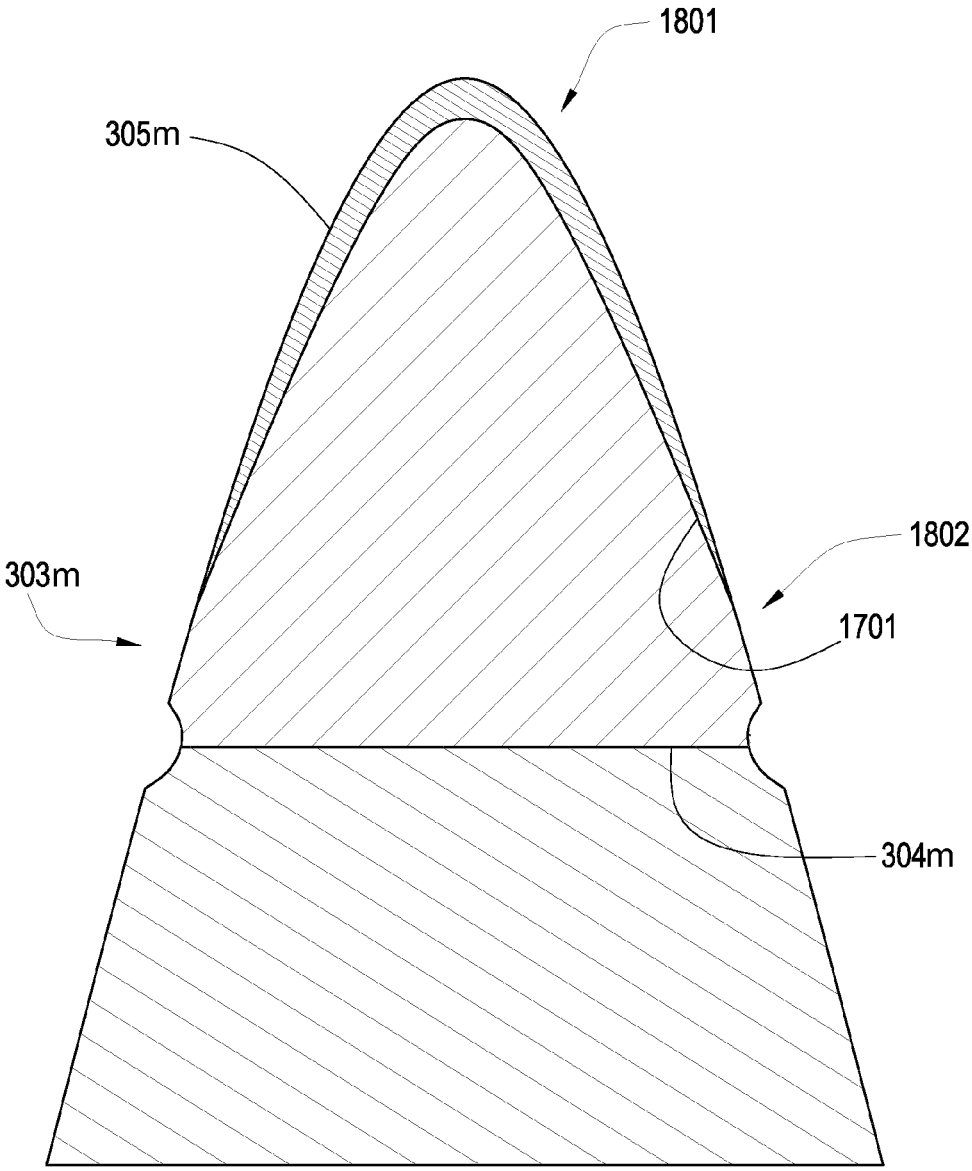
FIG. 18 is a cross-sectional diagram of another embodiment of a first wear-resistant segment and a second wear-resistant segment.

In FIG. 18 a second wear-resistant segment 303*m* may be conical in shape. A conical shape may allow for a smaller tip 1801 while having a larger area to braze at a brazed joint 304*m*. Other embodiments of the second wear-resistant segment 303*m* include pyramidal, frustoconical, spherical, helical shapes. Also shown in FIG. 18, is that an affected zone, such as the affected zone 130*a* illustrated in FIG. 4, has been removed such that an outer diameter 1802 of the second wear-resistant segment 303*m* increases the further away from the tip 1801 one measures the outer diameter 1802, but then the outer diameter 1802 decreases as it approaches a brazed joint 304*m*.

Figure 19:
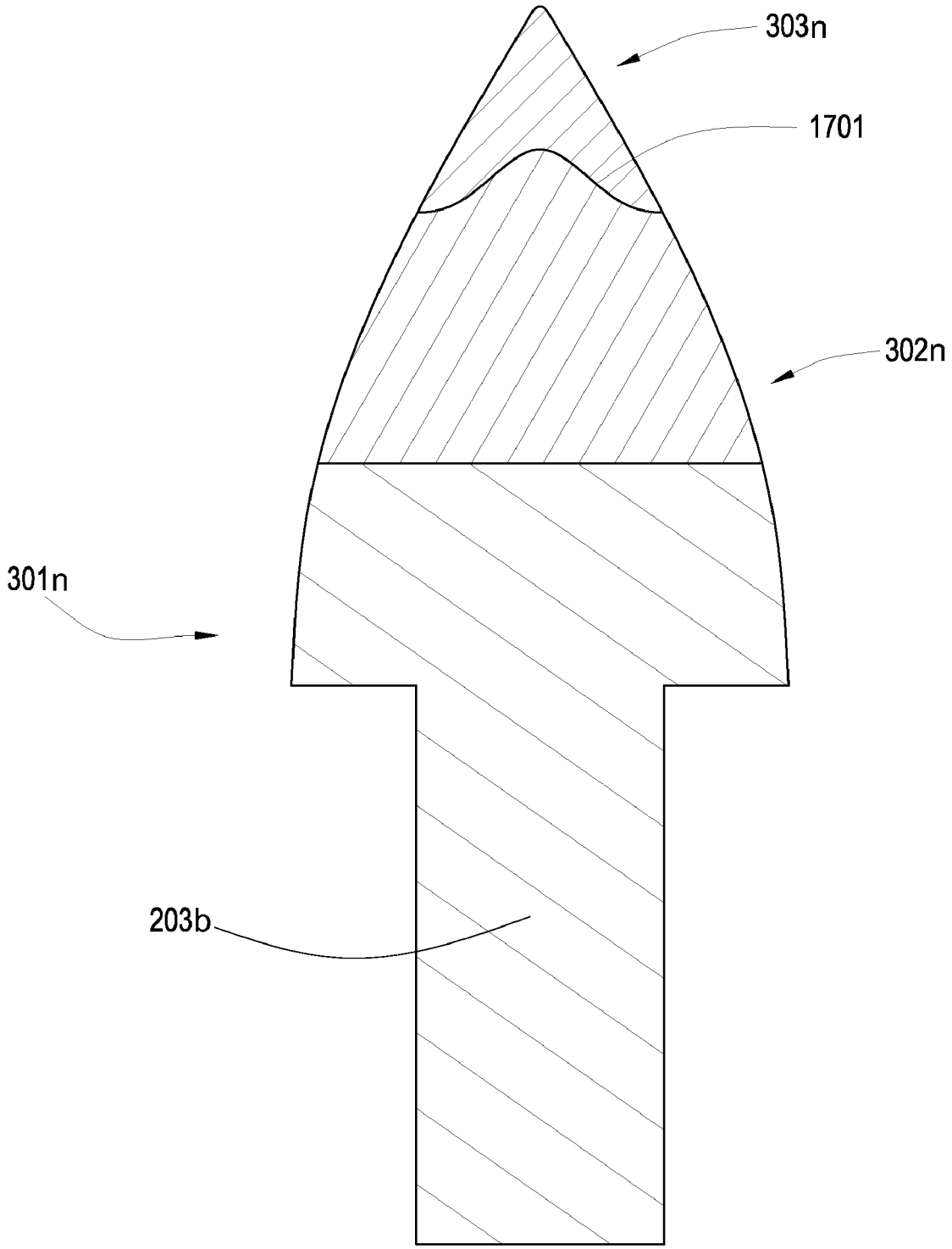
FIG. 19 is a cross-sectional diagram of another embodiment of a first wear-resistant segment and a second wear-resistant segment.

In FIG. 19, a second wear-resistant segment 303*n* is tungsten carbide without a superhard material, such as the superhard material 305*a* illustrated in FIG. 3, bonded to it. The second wear-resistant segment 303*n* may have a non-planar interface 1701 between it and a the first wear-resistant segment 302*n*, which may also comprise tungsten carbide, the second wear-resistant segment 303*n* being brazed to the first wear-resistant segment 302. The first wear-resistant segment 302*n* may be bonded to a base segment 301*n* comprising an attachment 203*b* that attaches to a driving mechanism, such as the driving mechanism 102 illustrated in FIG. 1.

Figure 20:
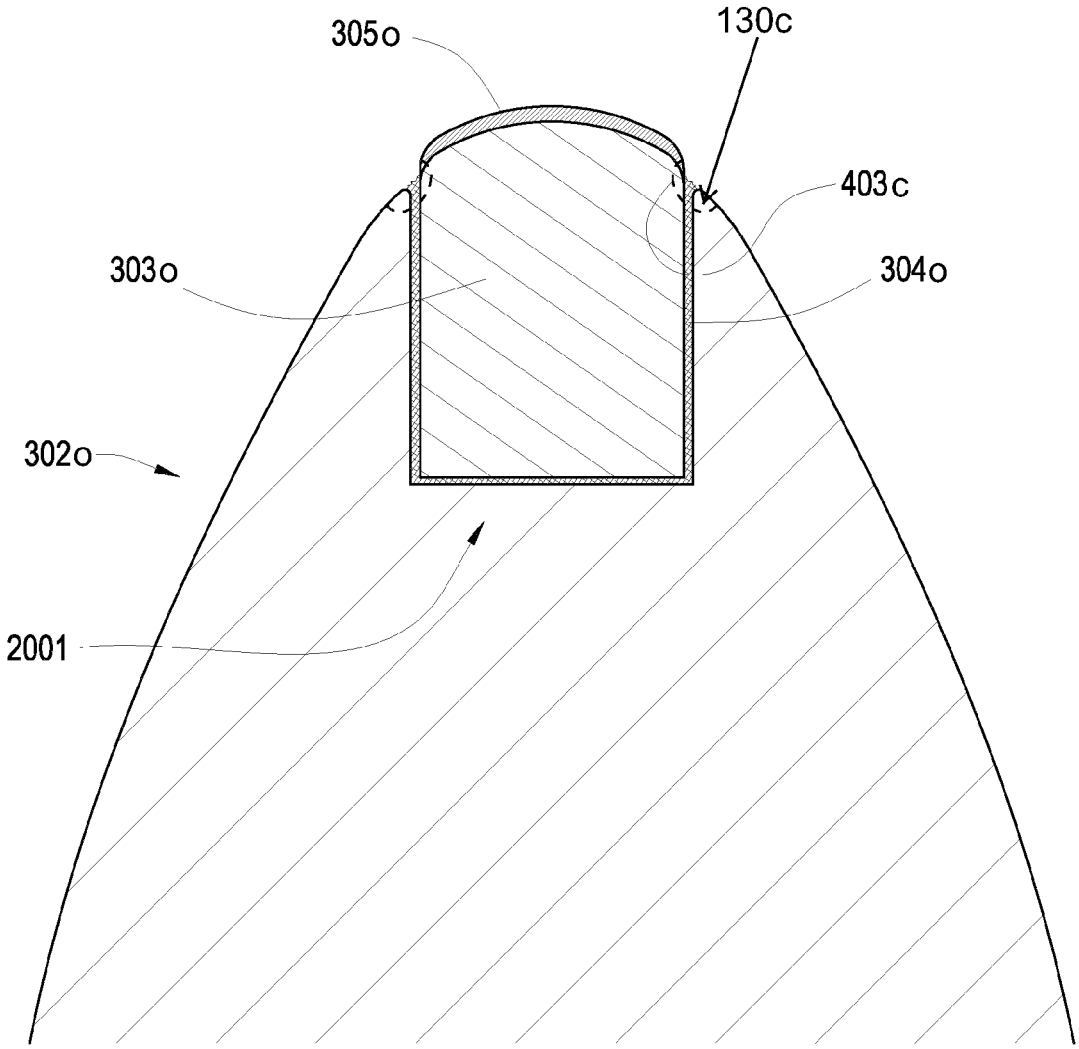
FIG. 20 is a cross-sectional diagram of an embodiment of a second wear-resistant segment brazed into a pocket of a first wear-resistant segment.

FIG. 20 is a cross-sectional diagram of an embodiment of a second wear-resistant segment 303*o* brazed into a pocket 2001 of a first wear-resistant segment 302*o*. The pocket 2001 may increase a surface area available for bonding the second wear-resistant segment 303*o* to the first wear-resistant segment 302*o*. The brazing process may create an affected zone 130*c* indicated by the dotted lines 403*c* that may not be entirely removable due to the location of the braze material between the first wear-resistant segment 302*o* and the second wear-resistant segment 303*o*. Some of the zone 130*c* may be ground to improve strength as discussed above.

Figure 21:
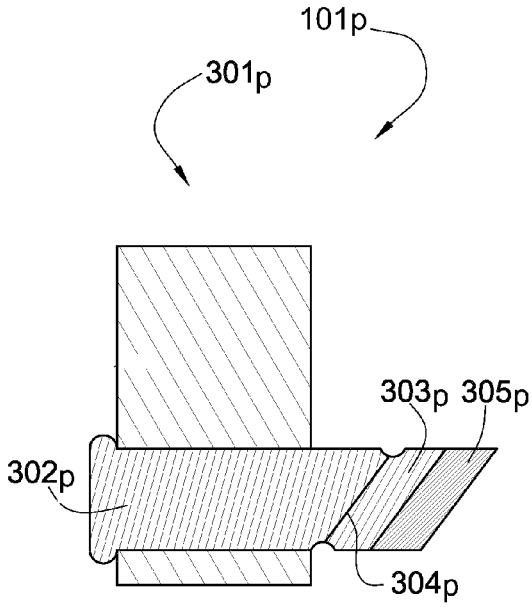
FIG. 21 is a cross-sectional diagram of another embodiment of an attack tool.

FIGS. 21 through 24 are cross-sectional diagrams of various embodiments of attack tools adapted to remain stationary within their respective holders, which are attached to a driving mechanism. In FIG. 21, an attack tool 101*p* may comprise a base segment 301*p* which may comprise steel, or a cemented metal carbide. The attack tool 101*p* may also comprise a first wear-resistant segment 302*p* and a second wear-resistant segment 303*p* bonded at a brazed joint 304*p*. The brazed joint 304*p* may also comprise affected zones, such as the affected zone 130*a* in FIG. 4, which may be removed by a finish grinding process. A rake angle of a superhard material 305*p* may be altered to change the cutting ability of the attack tool 101*p*. Positive or negative rake angles may be used. The layer of superhard material 305*p* may be from 1 to 6000 microns thick.

Figure 22:
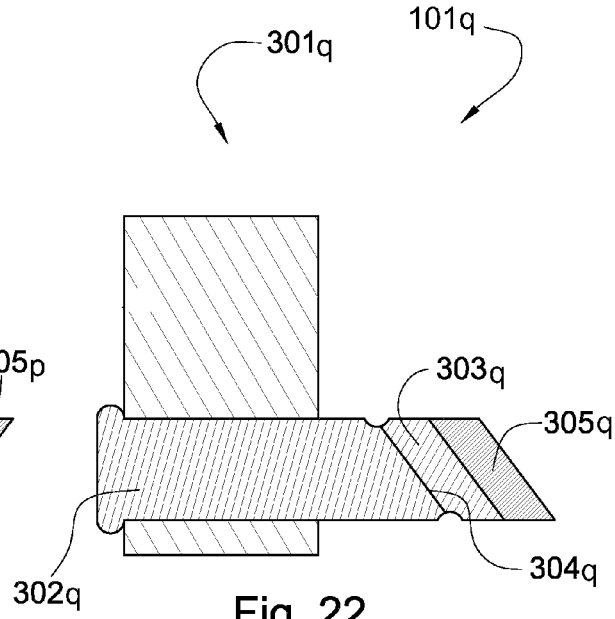
FIG. 22 is a cross-sectional diagram of another embodiment of an attack tool.

In FIG. 22, an attack tool 101*q* may comprise a base segment 301*q*, a first wear-resistant segment 302*q* and a second wear-resistant segment 303*q* bonded at a brazed joint 304*q*, and a superhard material 305*q*.

Figure 23:
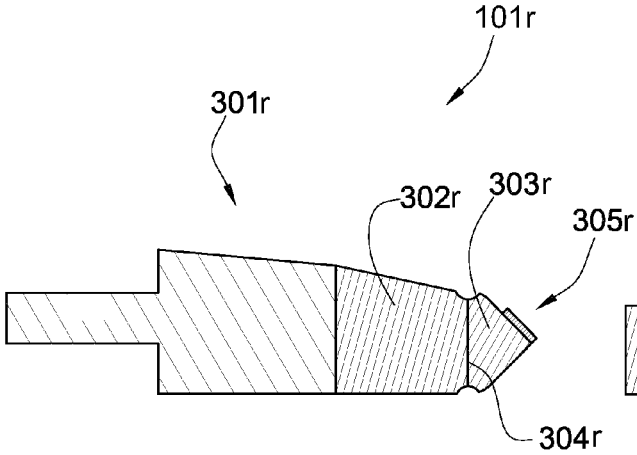
FIG. 23 is a cross-sectional diagram of another embodiment of an attack tool.

In FIG. 23, an attack tool 101*r* may comprise a base segment 301*r*, a first wear-resistant segment 302*r* and a second wear-resistant segment 303*r* bonded at a brazed joint 304*r*, and a superhard material 305*r*.

Figure 24:
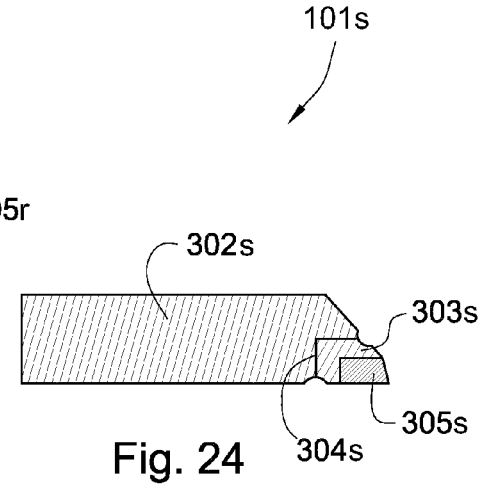
FIG. 24 is a cross-sectional diagram of another embodiment of an attack tool.

In FIG. 24, an attack tool 101*s* may comprise a first wear-resistant segment 302*s* and a second wear-resistant segment 303*s* bonded at a brazed joint 304*s*, and a superhard material 305*s*.

Figure 25:
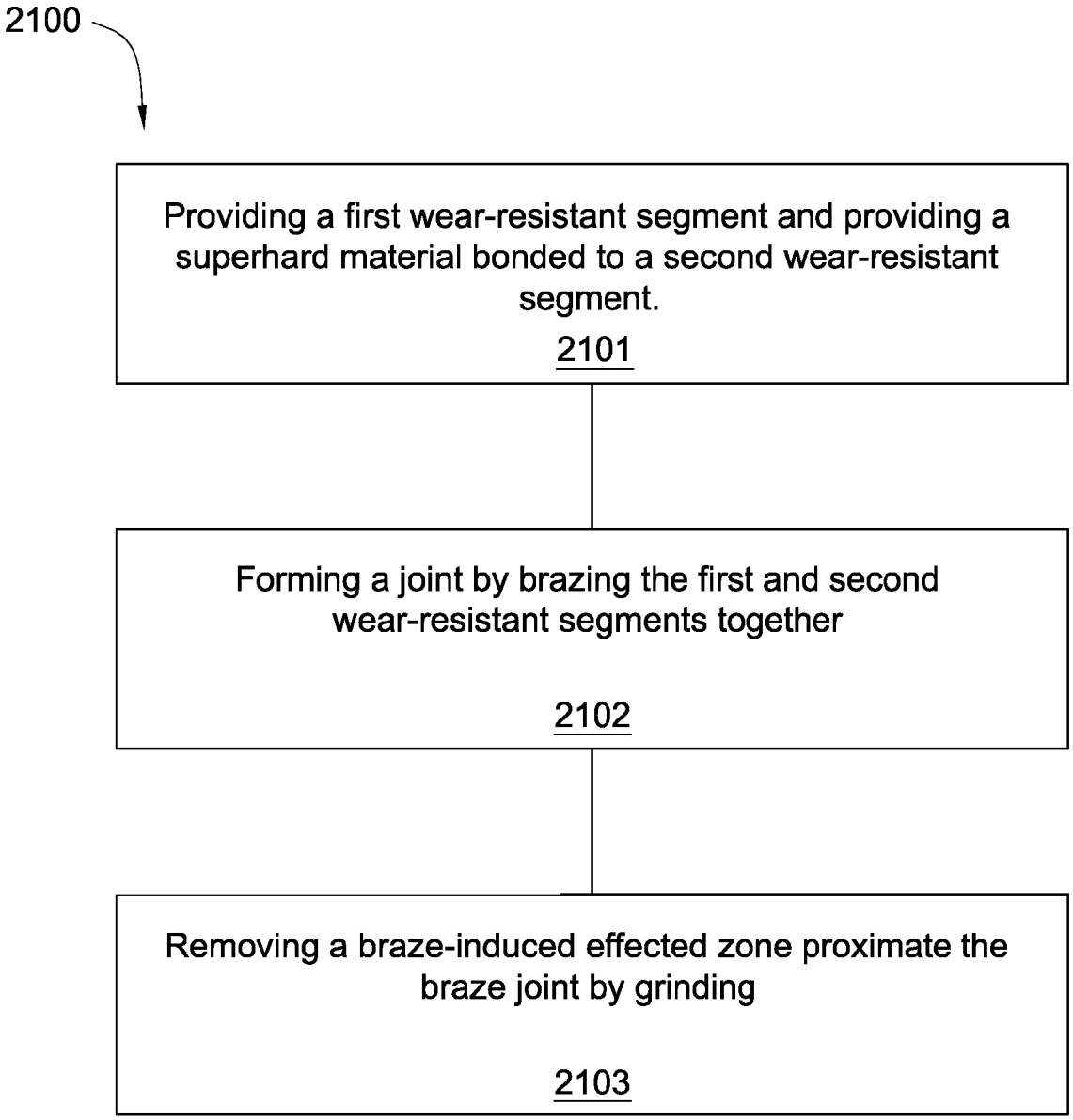
FIG. 25 is a schematic of an embodiment of a method for manufacturing an attack tool.

FIG. 25 is a schematic of an embodiment of a method 2100 for manufacturing an embodiment of attack tools described above. The method 2100 may comprise the steps of providing 2101 a first wear-resistant segment and providing a superhard material bonded to a second wear-resistant segment, forming 2102 a brazed joint by brazing the first wear-resistant segment and the second wear-resistant segment together, and removing 2103 a braze-induced affected zone proximate the brazed joint by grinding.

In the method 2100, the wear-resistant segments may comprise steel, a cemented metal carbide, tungsten, niobium, silicon, or combinations thereof. The step for forming 2102 a joint by brazing may comprise using a braze material comprising silver, gold, copper, nickel, palladium, boron, chromium, silicon, germanium, aluminum, iron, cobalt, manganese, titanium, tin, gallium, vanadium, indium, phosphorus, molybdenum, platinum, or combinations thereof.

Figure 26:
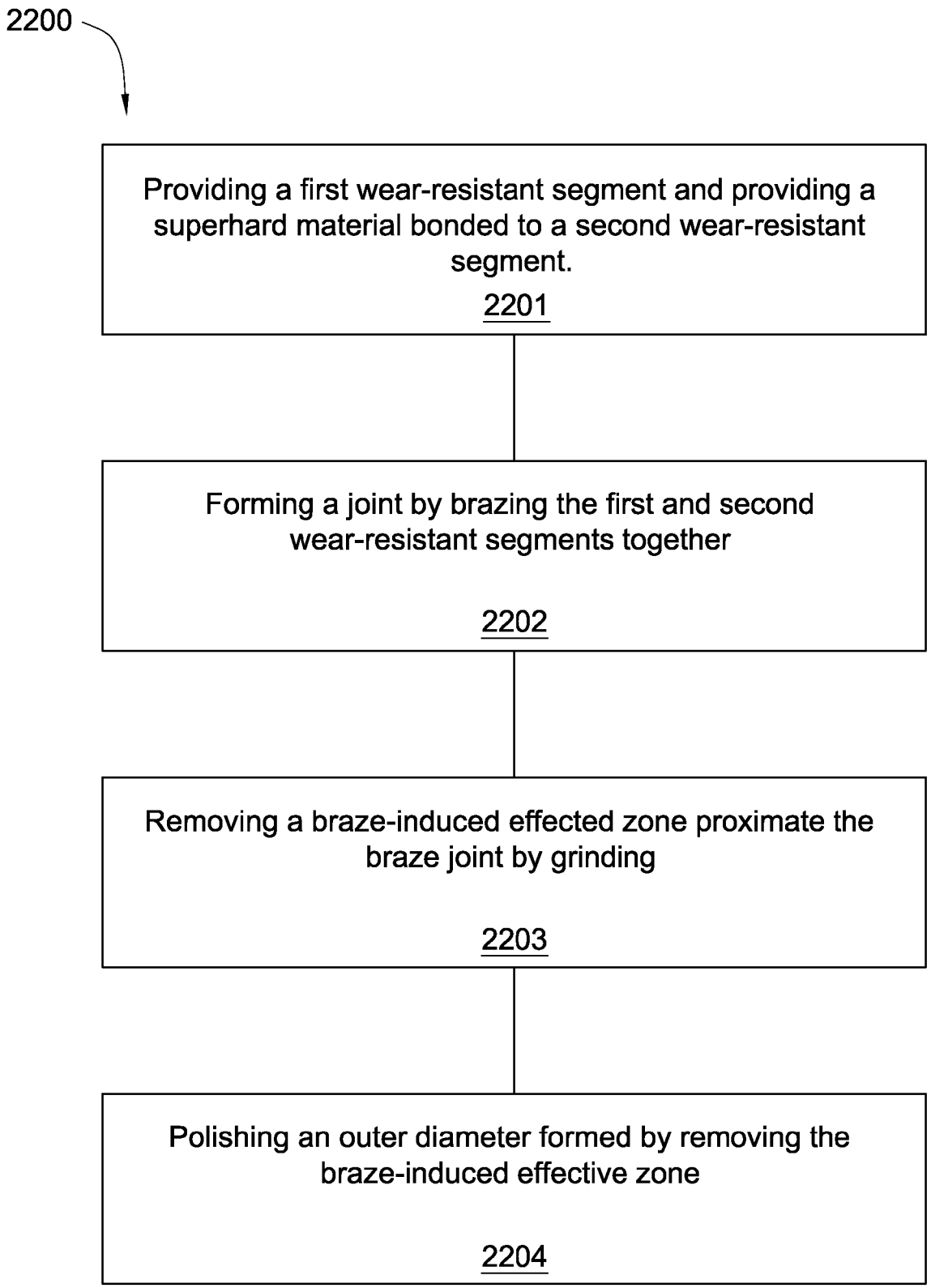
FIG. 26 is a schematic of another embodiment of a method for manufacturing an attack tool.

FIG. 26 is a schematic of another embodiment of a method 2200 for manufacturing an embodiment of attack tools described above. The method 2200 may comprise the steps of providing 2201 a first wear-resistant segment and providing a superhard material bonded to a second wear-resistant segment, forming 2202 a brazed joint by brazing the first wear-resistant segment and the second wear-resistant segments together, and removing 2203 a braze-induced affected zone proximate the brazed joint by grinding. The method 2200 may further comprise another step of polishing 2204 an outer diameter formed by removing the braze-induced affected zone. That is, when cracks, ruts, or other similar irregularities and/or imperfections may be left behind from grinding these, irregularities and imperfections may be removed by polishing the finish ground surface, which may result in a stronger tool.

What is claimed is:

1. An attack tool for degrading materials, comprising:

a steel base segment comprising a shaft for attachment to a driving mechanism;

a first carbide segment bonded to the steel base segment and located distal to the steel base segment; and a second carbide segment located distal to the first carbide segment and bonded to the first carbide segment at a brazed joint opposite the steel base segment, wherein at least a portion of exterior surfaces of the first and second carbide segments directly adjacent to and at the brazed joint comprise a polished, finish ground surface, and wherein the first carbide segment proximal to and adjacent the brazed joint comprises a shelf joined by a concave radius of a fillet, the concave radius of the fillet measuring between 0.005 to 0.600 inches.

2. The attack tool of claim 1, wherein diamond is bonded to the second carbide segment opposite the brazed joint.

3. The attack tool of claim 2, wherein the diamond comprises a domed, rounded, semi-rounded, conical, flat, or pointed geometry.

4. The attack tool of claim 2, wherein the diamond comprises natural diamond, polycrystalline diamond, or combinations thereof.

5. The attack tool of claim 2, wherein an interface between the diamond and second carbide segment is non-planar.

6. The attack tool of claim 1, wherein the brazed joint comprises a braze material comprising silver, gold, copper, nickel, palladium, boron, chromium, silicon, germanium, aluminum, iron, cobalt, manganese, titanium, tin, gallium, vanadium, indium, phosphorus, molybdenum or platinum.

7. The attack tool of claim 1, wherein the shaft is adapted to rotate within a holder.

8. The attack tool of claim 1, wherein a durable coating covers surfaces of the steel base segment.

9. An attack tool for attachment to a driving mechanism and for degrading materials, the attack tool comprising:

a base segment and a shaft;

a first carbide segment bonded to the base segment and located distal to the base segment;

a second carbide segment located distal to the first carbide segment and bonded to the first carbide segment at a brazed joint opposite the base segment, wherein a distal-most exterior surface of the second carbide segment corresponds to a distal-most portion of the attack tool, and wherein the distal-most exterior surface of the second carbide segment includes a superhard material, wherein at least portions of exterior surfaces of the first and second carbide segments directly adjacent to and at the brazed joint include a polished, finish ground surface, and wherein the first carbide segment proximal to and directly adjacent the brazed joint includes a concave portion and a shelf adjacent thereto.

10. The attack tool of claim 9, wherein the concave portion includes a radius that measures between 0.005 to 0.600 inches.

11. The attack tool of claim 9, wherein the superhard material comprises a domed, rounded, semi-rounded, conical, flat, or pointed geometry.

12. The attack tool of claim 9, wherein the superhard material comprises natural diamond, polycrystalline diamond, or combinations thereof.

13. The attack tool of claim 9, wherein an interface between the superhard material and second carbide segment is non-planar.

14. The attack tool of claim 9, wherein the brazed joint comprises a braze material including silver, gold, copper, nickel, palladium, boron, chromium, silicon, germanium, aluminum, iron, cobalt, manganese, titanium, tin, gallium, vanadium, indium, phosphorus, molybdenum and platinum.

15. The attack tool of claim 9, wherein the shaft is adapted to rotate within a holder attached to the driving mechanism.

16. The attack tool of claim 9, wherein a durable coating covers surfaces of the base segment.

* * * * *